US005789048A

United States Patent [19]

Flieger

[11] Patent Number: 5,789,048

[45] Date of Patent: Aug. 4, 1998

[54] PACKAGE CONSUMABLE IN MELT PROCESSING

[75] Inventor: Hans Dieter Flieger, Vessy, Switzerland

[73] Assignee: E. I. du Pont de Nemours and Company, Wilmington, Del.

[21] Appl. No.: 726,034

[22] Filed: Oct. 7, 1996

Related U.S. Application Data

[63] Continuation of Ser. No. 284,656, filed as PCT/US93/01286 published as WO93/17067 Sep. 2, 1993, abandoned.

[30] Foreign Application Priority Data

Feb. 22, 1992 [DE] Germany ..... 45 05 418.4

[51] Int. Cl.[6] ..... B32B 27/00; B32B 27/16; B32B 27/30; B32B 27/32

[52] U.S. Cl. ..... 428/36.92; 428/35.7; 428/332; 428/339; 428/522; 525/329.7; 525/330.2; 526/317.1; 526/318.6; 206/524.1; 206/524.6; 206/524.7

[58] Field of Search ..... 428/35.2, 35.5, 428/35.7, 36.8, 36.92, 522, 332, 339; 206/219, 447, 524.1, 524.6, 524.7; 525/329.5, 329.7, 330.2; 526/317.1, 318.6

[56] References Cited

U.S. PATENT DOCUMENTS

| | | | |
|---|---|---|---|
| 3,264,272 | 8/1966 | Rees | 260/78.5 |
| 3,404,134 | 10/1968 | Rees | 260/78.5 |
| 3,520,861 | 7/1970 | Thomson et al. | 260/88.1 |
| 4,190,156 | 2/1980 | Adam | 206/447 |
| 4,248,348 | 2/1981 | Butler et al. | 206/447 |
| 4,248,990 | 2/1981 | Pieski et al. | 526/317 |
| 4,252,924 | 2/1981 | Chatterjee | 526/65 |
| 4,334,615 | 6/1982 | Butler et al. | 206/447 |
| 4,351,931 | 9/1982 | Armitage | 526/227 |
| 4,394,473 | 7/1983 | Winter et al. | 524/226 |
| 5,028,674 | 7/1991 | Hatch et al. | 526/216 |
| 5,120,787 | 6/1992 | Drasner | 524/524 |
| 5,189,113 | 2/1993 | Muehlenbernd et al. | 525/329.5 |

FOREIGN PATENT DOCUMENTS

| | | |
|---|---|---|
| 0 270 502 | 11/1987 | European Pat. Off. . |
| 0 270 902 | 6/1988 | European Pat. Off. . |
| 53-142443 | 12/1978 | Japan . |
| 54-2349 | 1/1979 | Japan . |

*Primary Examiner*—Vivian Chen
*Attorney, Agent, or Firm*—Craig H. Evans

[57] ABSTRACT

A consumable package for use in melt-processing operation comprises a container and a melt-processable product such as polymers, elastomers, or additives. The container is formed from a film made from a random ionomer copolymer comprising of ethylene and 20–45 wt % of an unsaturated monocarboxylic acid, the copolymer being neutralized with a metal ion such as lithium, sodium, magnesium, or zinc. The film has a low melting point and a stiffness of greater than 400 megapascals.

8 Claims, No Drawings

PACKAGE CONSUMABLE IN MELT PROCESSING

This is a continuation of application Ser. No. 08/284,656, filed as PCT/US93/01286 Feb. 19, 1993 published as WO93/17067 Sep. 2, 1993, now abandoned.

BACKGROUND OF THE INVENTION

1. Field of the Invention

This invention relates to packages of melt processable products and more particularly to such packages which use films as packaging containers which are consumable with the melt processable products retained therein.

2. Background Art

The packaging and shipment of products always involves the question—what happens to the packaging materials? Today, packaging materials can be either incinerated, land-filled, or recycled. As environmental legislation becomes more strict, the incineration or land-filling of packaging materials will no longer be feasible.

Polymeric products and elastomers are conveniently packaged in 25 kg bags which, after the contents are removed, are then typically incinerated or sent to a land-fill. Thus, there is a need for heavy duty bags for such products whose disposal does not involve environmental problems. The bag waste-disposal problems for such products have been solved by the present invention by using a bag which is incorporated into a final product along with the contents of the bag.

SUMMARY OF THE INVENTION

According to the present invention there is provided a consumable package capable of being used in a melt-processing operation which comprises: a container and a melt-processable product retained therein, said container comprising a film of an ethylene copolymer having a melting point lower than the temperature of the melt-processing operation and a stiffness measured by ASTM D882 of greater than 400 megapascals.

DETAILED DESCRIPTION OF THE INVENTION

Products packaged according to the present invention are those which will be used in a melt processing operation. A melt processing operation is one where various materials are heated and mixed together. Heating is typically above the softening point of the main meltable material so that it flows while being mixed. Mixing is typically carried out in blenders, milling or mixing rolls, calenders and extruders.

Melt processable products typically are polymers, elastomers and additives for these products such as pigments and fillers. For example, NEOPRENE elastomer is heated to 85°–95° C., kneaded at this temperature optionally with other additives, calendered or pressed and cured. Hot melt adhesives are prepared from ethylene/vinyl acetate copolymers; these copolymers can be packaged according to the invention and then processed in heated mixing equipment as is normal practice. The bag can be split in two or shredded prior to addition in the equipment.

A film for making a bag or other container for packaging a melt processable product is a flat extruded or blown extruded film of a film-forming ethylene copolymer which has a melting point lower than the temperature of the melt processing operation used for the packaged product and a stiffness as measured by ASTM D 882 greater than 400 megapascals. Typically such copolymers will be ethylene/acid copolymers and ionomers derived therefrom. Ionomers are preferred.

Methods of preparing ionomers from ethylene/acid copolymers are well known and are described in U.S. Pat. No. 3,264,272 (Rees) which is herein incorporated by reference. Preparation of direct acid copolymers on which ionomers are based is described in U.S. Pat. No. 4,351,931 (Armitage) which is also incorporated herein by reference. Acid copolymers with high levels of acid can present fouling problems in continuous polymerizers. These can be avoided, however, by use of "cosolvent technology" as described in U.S. Pat. No. 5,028,674 (Hatch et al).

The correct combination of melting point and stiffness for any ethylene copolymer can be varied by changing the content of unsaturated monocarboxylic acid in the copolymer, the percent neutralization of the acid by a metal ion, and the metal ion used. Ionomers produced from polymers of ethylene/acrylic acid or methacrylic acid containing greater than 15% by weight acid are stiffer than ionomers containing less acid. Melting point of the copolymers decrease with increasing acid level; neutralization does not have too much effect on it.

For example, LDPE with no acid melts at about 114° C. and an ethylene/15% by weight methacrylic acid copolymer melts at about 90° C. Melting point and crystallinity both decrease until an acid level of about 45% methacrylic acid is reached.

Stiffness of the ethylene copolymer can be varied by varying the metal ion used for neutralization of the acid contained in the copolymer. Lithium ionomers tend to give the stiffest copolymers followed by sodium, magnesium and zinc amongst the common metals used in ionomers. It is necessary to go to high acid levels without neutralization to increase stiffness to the same extent as a lower acid level with neutralization. Preferred ethylene copolymers for most uses will have a melting point in the range of 75°–95° C. and a stiffness greater than 500 megapascals, preferably in the range of 500 to 650.

With consideration of the above parameters for ethylene copolymer melting point and stiffness, the copolymer will comprise 55–90% by weight of ethylene and 10–45% by weight of an unsaturated monocarboxylic acid having 3–8 carbon carbons, preferably acrylic acid or methacrylic acid. The acid in the copolymer is neutralized from 0–40% by at least one metal ion selected from lithium, sodium, magnesium and zinc, preferably lithium and sodium alone or in combination with other metal ions. Useful copolymers contain 10–25% by weight of the acid which is neutralized at a level of 10–40% by at least one metal ion; or contain 25–45% by weight of the acid with less neutralization, typically from 0–10%. Preferred is an ethylene copolymer which contains 15–25% by weight of methacrylic acid which is neutralized from 20–40% by sodium ion. Neutralization with lithium can also be used to provide a stiffer polymer.

The ethylene copolymers useful in the present invention are made into films according to any procedure known to those skilled in the art, including flat film extrusion and blown film extrusion. The thickness of the film used depends upon the size and weight of the package. Typically, a film thickness of 70–125 microns should be adequate for 25 kg bags of polymers and elastomers. The film for the bags can be formed of one layer or it can be of several coextruded layers, each layer providing different properties for different kinds of contents protection.

For example, there can be a black inner layer for ultraviolet light protection, a white middle layer for appearance, and a clear outer layer for printability and tackiness. Tackiness is desirable so that the bags can be stacked with minimal slippage.

Packages of the invention are used by simply placing the entire bag and contents into the melt processing operation. The bag melts during processing and is incorporated into the final product along with the contents of the bag. The amount of polymer from the bag is small in the final product; thus, there is minimal if any effect on the properties of the final product.

The invention can be understood by the following examples in which parts and percentages are by weight and temperature is in degrees Celsius:

EXAMPLE 1

An ionomer copolymer (80% ethylene/20% methacrylic acid neutralized 35% with sodium ions; melt flow index of 2.6 at 190° and 2.16 kg) was made into films 80 microns and 120 microns in thickness using conventional blow film extrusion equipment and conditions applicable.

The copolymer was extruded through a die gap of 0.8 mm, at a temperature of 200° using a blow up ratio of 1:2.5. Film thickness was controlled by extruder screw speed. The film tube was wound-up flat. This film melts at 85° and has a secant modulus stiffness as measured by ASTM D882 of 517 MPa.

The resulting copolymer tube is opened, sealed at a temperature of 95° with a heat seal bar so as to provide bag bottom seals, and then cut so as to provide a pillow bag. Bags are filled with 25 kg of NEOPRENE (chloroprene elastomer) and closed by either sewing with polymeric filaments which melt at a temperature below 95° or by heat sealing at 95° with a heat seal bar.

The NEOPRENE-filled bags are strong and durable enough to carry NEOPRENE, with identification and lot number information from the plant through storage and transit to the customer's mixing area, without damage. They need not be opened, but the bags together with the NEOPRENE contents can be added directly to the internal mixer where it is compounded with other ingredients. As a result, there is no disposal problem for the bag which will melt under normal mixing temperature (90°–95°) and be incorporated fully into the compound giving negligible effect on the subsequent properties of the compound.

EXAMPLE 2

Multi-layer tubular bags are made by a blown film process using the copolymer described in Example 1. The bags are 120 microns in thickness and comprise a black pigmented inner layer 40 microns in thickness, a white pigmented middle layer 40 microns in thickness, and a transparent outer layer 20 microns in thickness.

The bags are filled with NEOPRENE and when placed in a rubber mill there is no evidence of the bags in the resulting NEOPRENE product.

What is claimed is:

1. A consumable package capable of being used in a melt-processing operation which comprises: a container and a melt-processable product retained therein, said container comprising a film of a random copolymer of ethylene and about 20 to 45 percent by weight of an unsaturated monocarboxylic acid having 3–8% carbon atoms, said copolymer neutralized sufficiently in the range of 10–40% by at least one metal ion selected from lithium, sodium, magnesium and zinc to result in a partially neutralized copolymer having a melting point lower than the temperature of the melt-processing operation and a stiffness measured by ASTM 882 of greater than 400 megapascals.

2. The package according to claim 1 wherein the partially neutralized copolymer has a melting point in the range of 75°–95° C. and a stiffness greater than 500 megapascals.

3. The package of claim 1 wherein the ethylene copolymer contains 15–25% by weight of acrylic or methacrylic acid which is neutralized from 20–40% by at least one metal ion selected from sodium and lithium.

4. The package of claim 1 wherein the ethylene copolymer contains 25–45% by weight of acrylic acid which is neutralized from 0–10%.

5. The package of claim 1 or any one of claims 2, 3, and 4 wherein the film is 70–125 microns in thickness.

6. The package of claim 1 or any one of claims 2, 3 and 4 wherein the melt-processable product is a polymer, an elastomer, asphalt, or an additive which is blended with a polymer or elastomer.

7. The package of claim 5 wherein the container is a bag.

8. The package of claim 6 wherein the film is 70–125 microns in thickness.

* * * * *

UNITED STATES PATENT AND TRADEMARK OFFICE

CERTIFICATE OF CORRECTION

PATENT NO. : 5,789,048

DATED : August 4, 1998

INVENTOR(S) : Hans Dieter Flieger

It is certified that error appears in the above-identified patent and that said Letters Patent is hereby corrected as shown below:

Column 4, line 31, claim 3, change "15-25%" to --about 20-25%--

Signed and Sealed this

Sixteenth Day of March, 1999

*Attest:*

Q. TODD DICKINSON

*Attesting Officer*

*Acting Commissioner of Patents and Trademarks*